US006764329B2

(12) United States Patent
Noguchi et al.

(10) Patent No.: US 6,764,329 B2
(45) Date of Patent: Jul. 20, 2004

(54) WATERPROOF RESILIENT PLUG TO PROVIDE SEALING BETWEEN A WIRE AND A HOUSING

(75) Inventors: Hirotaka Noguchi, Yokkaichi (JP); Masaaki Tabata, Yokkaichi (JP); Masanori Wakui, Toyota (JP); Keiichi Itou, Toyota (JP)

(73) Assignee: Sumitomo Wiring Systems, Inc., Yokkaichi (JP)

( * ) Notice: Subject to any disclaimer, the term of this patent is extended or adjusted under 35 U.S.C. 154(b) by 0 days.

(21) Appl. No.: 10/309,367

(22) Filed: Dec. 2, 2002

(65) Prior Publication Data

US 2004/0106316 A1 Jun. 3, 2004

(30) Foreign Application Priority Data

Dec. 4, 2001 (JP) ..... 2001-369595

(51) Int. Cl.[7] ..... H01R 13/52; H01R 13/40
(52) U.S. Cl. ..... 439/273; 439/587
(58) Field of Search ..... 439/273, 272, 439/271

(56) References Cited

U.S. PATENT DOCUMENTS 3,760,332 A * 9/1973 Berkovits et al. ..... 439/381
4,717,355 A * 1/1988 Mattis ..... 439/452
5,336,101 A * 8/1994 Kasugai et al. ..... 439/272
6,109,945 A * 8/2000 Creelle et al. ..... 439/278
6,361,378 B1 * 3/2002 Konoya et al. ..... 439/752
6,368,132 B1 * 4/2002 Okayasu ..... 439/273
6,582,242 B2 * 6/2003 Murakami et al. ..... 439/271

FOREIGN PATENT DOCUMENTS

JP 7-282893 10/1995

* cited by examiner

*Primary Examiner*—Chandrika Prasad
(74) *Attorney, Agent, or Firm*—Anthony J. Casella; Gerald E. Hespos

(57) ABSTRACT

A waterproof resilient plug (20) has a trunk portion (11) to be brought into close contact with the inner circumferential surface of a terminal insertion hole (C) and a fixing portion (12) extending from the leading end of the trunk (11) and to be pressed against the outer circumferential surface of a wire (W) by insulation barrels (20*a*). The plug (20) is formed along its longitudinal axis with a wire insertion hole (13) that can be brought into close resilient contact with the outer surface of the (W). An inner diameter of the wire insertion hole (13) aligned with the fixing portion (12) is smaller than the one at the side of trunk (11), whereby the fixing portion (12) can be held strongly in close contact with the outer surface of the wire (W).

16 Claims, 3 Drawing Sheets

WATERPROOF RESILIENT PLUG TO PROVIDE SEALING BETWEEN A WIRE AND A HOUSING

BACKGROUND OF THE INVENTION

1. Field of the Invention

The invention relates to a waterproof resilient plug, and particularly a waterproof plug that can be mounted to a terminal fitting and inserted into a terminal insertion hole of a connector housing.

2. Description of the Related Art

Japanese Unexamined Patent Publication No. 7-282893 and FIGS. 4(A) and 4(B) herein disclose a terminal fitting 1 with opposite front and rear ends. Insulation barrels 1*a* are adjacent the rear end of the terminal fitting 1 and wire barrels 1*b* are forward of the insulation barrels 1*a*. The terminal fitting 1 is used with a wire W and a tube-shaped waterproof rubber plug 2. The plug 2 has lips 2*a* on the outer circumferential surface and a fixing portion 2*b* at the leading end of the plug 2. As shown in FIG. 4(B), the waterproof rubber plug 2 is slid over the wire W. The insulation barrels 1*a* then are crimped into connection with the fixing portion 2*b* of the plug 2 and the wire barrels 1 are crimped into connection with a core Wa exposed by stripping the insulation coating from the leading end of the wire W.

The connected fixing portion 2*b* is compressed in direction A, as shown in FIG. 4(B), and accordingly the leading end of the fixing portion 2*b* is turned up in direction B. The state of the plug 2 causes no problem if the terminal fitting is relatively large, and there is a diameter difference between the lips 2*a* of the waterproof rubber plug 2 and the fixing portion 2*b*. However, a problem may occur when there is only a small diameter difference between the lips 2*a* and the fixing portion 2*b*, such as in a miniaturized terminal fitting. Specifically, the turned-up front end of the fixing portion 2*b* may be caught by the inner circumferential surface of a terminal insertion hole C when the terminal fitting 1 is inserted into the terminal insertion hole C of a connector housing H. As a result, the insertion resistance increases, and in an extreme case, the fixing portion 2*b* may be disengaged from the insulation barrels 1*a*.

The invention was developed in view of the above problem and an object thereof is to provide an improved waterproof resilient plug.

SUMMARY OF THE INVENTION

The invention is directed to a waterproof resilient plug with a trunk that can be brought into close contact with the inner circumferential surface of a terminal insertion hole of a connector housing. The plug also has a fixing portion that extends from the leading end of the trunk. The fixing portion is configured for fixed connection to a terminal fitting. A wire insertion hole is formed through both the trunk and the fixing portion and is dimensioned for close resilient contact with the outer circumferential surface of the wire. The inner diameter of the wire insertion hole is smaller through the fixing portion than through the trunk. Accordingly, the plug can solve problems of an increased insertion resistance when a small terminal fitting with a waterproof resilient plug is inserted into a terminal insertion hole of a connector housing.

According to a preferred embodiment of the invention, the trunk has at least one lip formed on the outer circumferential surface thereof.

Preferably, the wire insertion hole is formed substantially along the longitudinal axes of the trunk and the fixing portion.

The fixing portion preferably is pressed against the outer circumferential surface of a wire by crimping, folding or bending one or more insulation barrels of the terminal fitting.

Resilient contact between the fixing portion of the waterproof rubber plug and the outer surface of the wire is closer than the resilient contact between the trunk and the outer surface of the wire. Thus, the leading end of the fixing portion is prevented from being turned up in a radially outer direction even if the fixing portion is compressed by crimping, bending or folding the insulation barrels of the terminal fitting into connection with the outer circumferential surface of the fixing portion. Thus, the leading end of the fixing portion will not turn up and catch the inner circumferential surface of the terminal insertion hole, and resistance is not increased during the insertion of the terminal. Further, the area in close contact with the wire is only the thin fixing portion and has a small diameter. Accordingly, insertion resistance is not increased during the insertion of the wire into the terminal insertion hole.

The inner diameter of the wire insertion hole at the fixing portion preferably is reduced gradually toward the front end of the fixing portion. As a result, the leading end of the fixing portion, which is more likely to be turned up by the crimping of the insulation barrels, can be held strongly in contact with the wire and prevented from being turned up. Therefore, the area to be held strongly in contact can be reduced, and an increase in the insertion resistance during the insertion of the wire into the wire insertion hole will be small.

Recesses preferably are formed in the inner circumferential surface of the trunk. The recesses may be formed at longitudinal positions substantially corresponding to the lips. Accordingly, the insertion resistance of the wire into the wire insertion hole is reduced.

The outer diameter of the fixing portion is gradually reduced towards a distal end thereof.

The fixing portion may comprise a chamfer at its distal end.

The fixing portion preferably is thinner than the trunk.

These and other features of the invention will become more apparent upon reading the following description of preferred embodiments and the drawings. It should be understood that even though embodiments are described separately, single features may be combined to other embodiments.

DETAILED DESCRIPTION OF THE PREFERRED EMBODIMENTS

Figure 1:
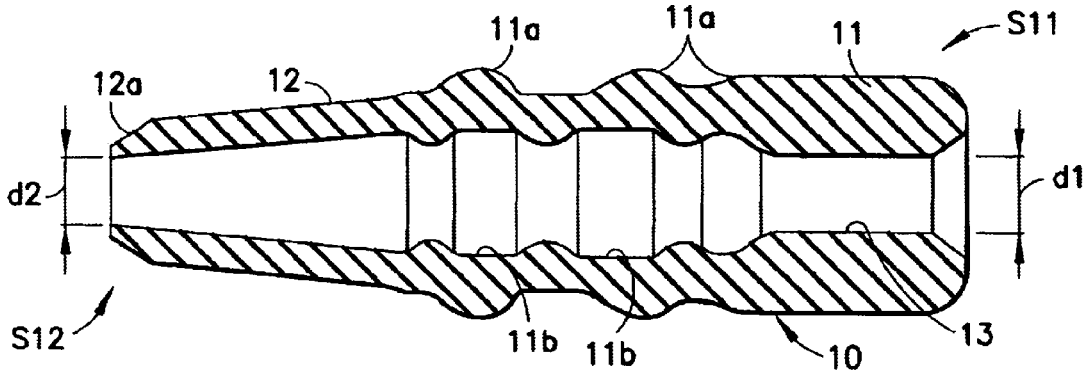
FIG. 1 is a vertical longitudinal section showing one embodiment of a waterproof rubber plug according to the invention.

FIG. 1 shows a waterproof plug 10 according to the invention. The waterproof plug 10 has a substantially tubular thick trunk 11 made of rubber or another resilient material, and a thin fixing portion 12 that extends integrally or unitarily from the leading end of the trunk 11. A wire insertion hole 13 is formed substantially along the longitudinal axis of the waterproof rubber plug 10 so that the waterproof plug 10 can be brought resiliently into close contact with the outer circumferential surface of a wire W.

Ring-shaped lips 11*a* project on the outer circumferential surface of the trunk 11 and are dimensioned for close contact with the inner circumferential surface of a terminal insertion hole C of a connector housing H at specified intervals. Additionally, recesses 11*b* are formed in the inner circumferential surface of the trunk 11 over substantially the entire circumference at positions corresponding to those of the lips 11*a* for reducing the insertion resistance of the wire W. The fixing portion 12, as shown in FIG. 2, is an area for fixing the waterproof rubber plug 10 to the outer circumferential surface of the wire W by insulation barrels 20*a* of the terminal fitting 20.

The wire insertion hole 13 has an inner diameter d2 at the side S12 of the fixing portion 12 that is smaller than an inner diameter d1 of the wire insertion hole 13 at the side S11 of the trunk 11 except the parts widened by the recesses 11*b*. Thus, a degree of resilient contact of the fixing portion 12 with the wire W is improved. More particularly, the inner and outer diameters of the fixing portion 12 are reduced from a boundary between the fixing portion 12 and the trunk 11 toward the leading end of the fixing portion 12. Further, a slanted portion 12*a* is formed on the outer circumferential surface of the leading end of the fixing portion 12. Thus, the leading end of the fixing portion 12 is tapered and stronger than the remaining portion of the fixing portion 12. In this embodiment, the inner diameters d1 and d2 of the trunk 11 and the fixing portion 12 preferably are: d1=1.15 mm and d2=1.0 mm when an outer diameter D of the wire W is 1,4 to 1,7 mm. Accordingly, the inner diameter d2 is smaller than d1 by more than 10% of d1. Further, both inner diameters d1 and d2 preferably are smaller than the outer diameter D of the wire W.

Figure 2:
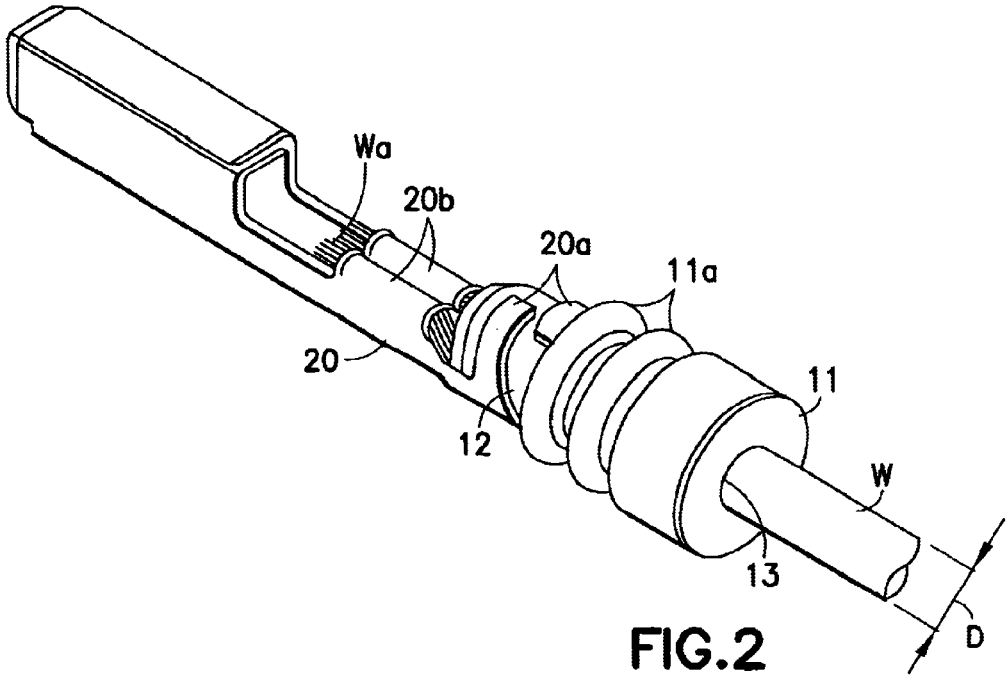
FIG. 2 is a perspective view showing the waterproof rubber plug mounted on a wire end is connected with a terminal fitting by crimping.
Figure 3:
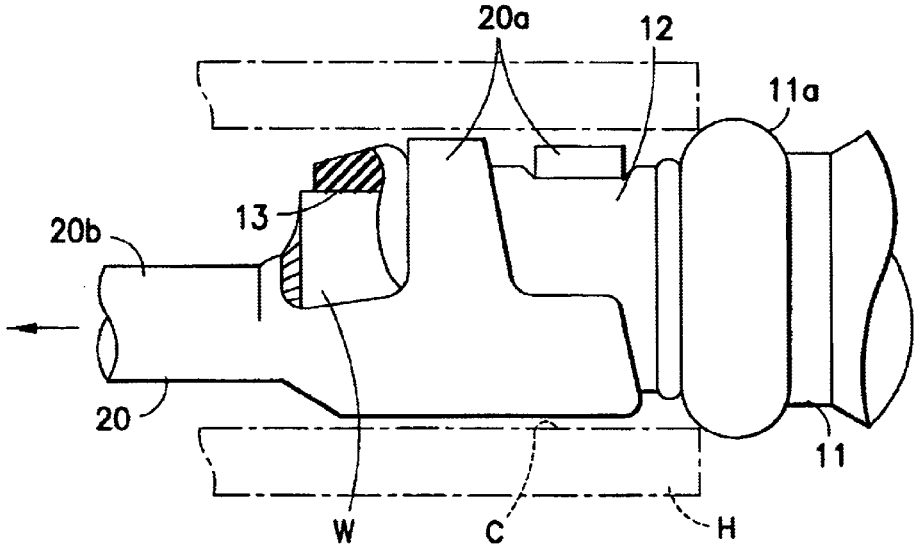
FIG. 3 is a partial enlarged view showing a relationship between an essential portion of a connected portion of the waterproof rubber plug and a terminal insertion hole of a connector housing.
Figure 4A:
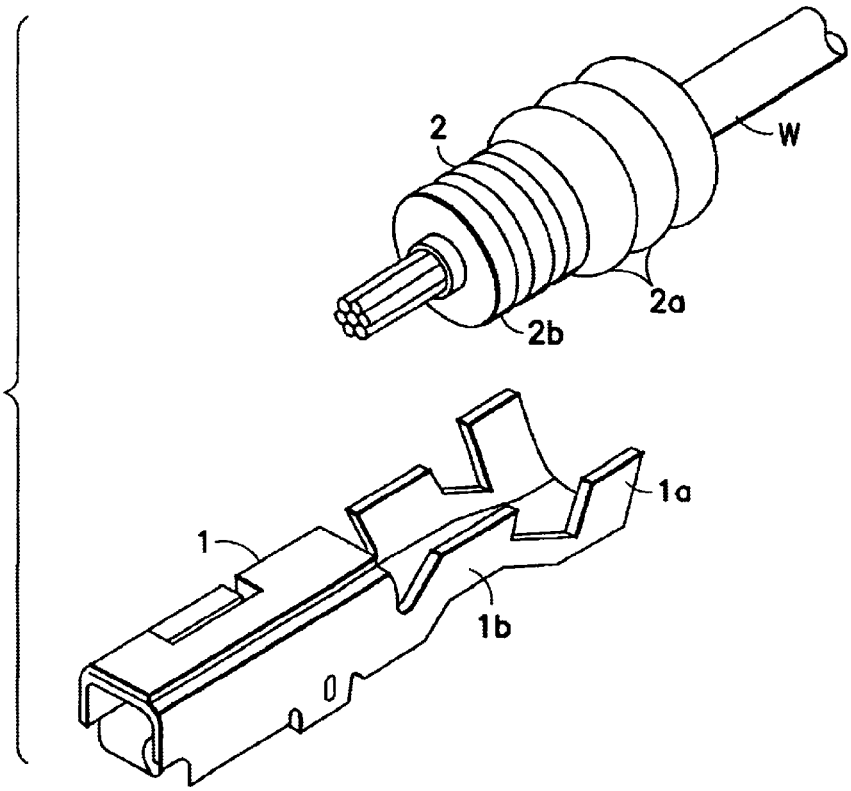
FIG.4A PRIOR ART
FIGS. 4(A) and 4(B) are views showing a prior art.
Figure 4B:
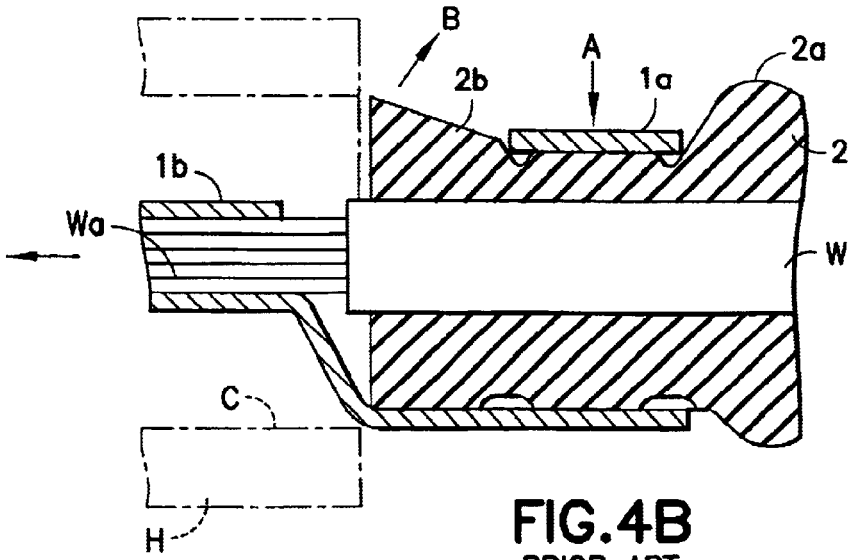
FIG.4B PRIOR ART

The waterproof rubber plug 10 can be mounted on the wire W by passing the end of the wire W through the wire insertion hole 13, as shown in FIGS. 2 and 3 The insulation then is striped from the end of the wire W to expose a core Wa. In this state, the fixing portion 12 is held resiliently in closer contact with the outer circumferential surface of the wire W than the trunk 11 because the fixing portion 12 has the smaller inner diameter d2. The leading end of the fixing portion 12 has the smallest inner diameter and thus is held in closest contact with the wire W. Insertion resistance increases only slightly during the inserting operation of the wire W into the waterproof rubber plug 10 because the fixing portion 12 is thinner than the trunk 11.

The wire W and the waterproof rubber plug 10 are positioned so that the fixing portion 12 corresponds to the insulation barrels 20*a* of the terminal fitting 20 and so that the core Wa corresponds to the wire barrels 20*b*. The terminal fitting 20 then is fixed to the wire W and the rubber plug 10 using a press. The terminal fitting 20 is connected strongly with the core Wa and has a sufficient electrical connection and a sufficient tensile strength. The terminal fitting 20 also slightly compress the waterproof plug 10 without damage.

The insulation barrels 20*a* are crimped into contact with the fixing portion 12 and wrap around the middle of the fixing portion 12 from opposite sides. This wrapped portion is compressed slightly to prevent the waterproof rubber plug 10 from coming out. An area at the leading end of the fixing portion 12 that projects from areas fixed by the insulation barrels 20 may try to turn up due to a reaction force. However, the leading end of the fixing portion 12 is held strongly in close resilient contact with the outer surface of the wire W. Thus, there is no increase in insertion resistance caused by the leading end of the fixing portion 12 of the waterproof rubber plug 10 getting caught by the inner circumferential surface of the terminal insertion hole C during the insertion of the terminal fitting 20 into the terminal insertion hole C.

As is clear from the above description, the leading end of the fixing portion is not turned up, even if the fixing portion of the waterproof rubber plug is compressed by the insulation barrels. This can prevent an increase in the insertion resistance of the terminal fitting caused by the contact of the turned-up leading end of the fixing portion with the inner circumferential surface of the terminal insertion hole of the connector housing.

Hence, the terminal fitting having the waterproof rubber plug mounted thereon can be smoothly inserted. Particularly, the present invention can be effectively applied to a smaller terminal fitting fitted with a waterproof rubber plug having a small diameter difference between lips and a fixing portion.

What is claimed is:

1. A waterproof plug formed from a resilient rubber material for providing sealing between a wire and a wire insertion hole of a housing, the plug, in an unbiased condition, comprising:

a trunk, at least a portion of the trunk having a cylindrical outer circumferential surface dimensioned for close contact with an inner circumferential surface of the housing defined by the terminal insertion hole of the housing;

a fixing portion extending from an end of the trunk and configured to be fixed to a terminal fitting; and a wire insertion hole formed through the trunk and the fixing portion, at least a section of the wire insertion hole formed through the trunk defining a cylindrical inner circumferential surface with an inner diameter dimensioned for close resilient contact with an outer circumferential surface of the wire, wherein the wire insertion hole in the fixing portion has an inner circumferential surface that tapers gradually at farther distances from the trunk such that an inner diameter of the wire insertion hole in the fixing portion is smaller than the inner diameter in the trunk, and wherein the fixing portion has an outer circumferential surface that tapers gradually at farther distances from the trunk such that an outer diameter defined by the fixing portion is reduced gradually at farther distances from the trunk.

2. The waterproof resilient plug of claim 1, wherein the trunk has an outer circumferential surface formed with at least one lip.

3. The waterproof resilient plug of claim 1, wherein the wire insertion hole is formed substantially along a longitudinal axis defined by the trunk and the fixing portion.

4. The waterproof resilient plug of claim 1, wherein the fixing portion is dimensioned to be pressed against the outer circumferential surface of a wire by crimping at least one insulation barrel (12*a*) of the terminal fitting (20).

5. The waterproof resilient plug of claim 1, wherein at least one annular recess is formed in an inner circumferential surface defined by the portion of the wire insertion hole in the trunk.

6. The waterproof resilient plug of claim 5, wherein the trunk has an outer circumferential surface formed with at least one lip, and wherein the recess is formed at at least one longitudinal position substantially corresponding to the lip.

7. The waterproof resilient plug of claim 1, wherein the fixing portion comprises a chamfered end.

8. The waterproof resilient plug of claim 7, wherein the fixing portion has a thinner wall thickness than that of the trunk.

9. A waterproof resilient plug unitarily formed from a resilient rubber material and having opposite first and second ends and an outer circumferential surface extending between the ends, a wire insertion hole extending between the first and second ends and defining an inner circumferential surface, a trunk extending from the first end toward the second end, and a fixing portion extending from the trunk to the second end, portions of the wire insertion hole extending through the trunk being substantially cylindrical and defining a substantially uniform first internal diameter, portions of the wire insertion hole extending through the fixing portion being gradually reduced from the first diameter adjacent the trunk to a second diameter at locations in proximity to the second end when the fixing portion is in an unbiased condition, the second diameter being smaller than the first internal diameter and wherein an outer diameter defined by the fixing portion is reduced gradually at farther distances from the trunk.

10. The waterproof resilient plug of claim 9, wherein the trunk has an outer circumferential surface formed with a plurality of annular lips.

11. The waterproof resilient plug of claim 10, wherein annular recesses are formed in the wire insertion hole at locations aligned with the lips.

12. The waterproof resilient plug of claim 9, wherein the fixing portion comprises a chamfer at the second end.

13. The waterproof resilient plug of claim 12, wherein the fixing portion has a thinner wall thickness than that of the trunk.

14. A connector, comprising:

a waterproof plug unitarily formed from a resilient rubber material and having opposite first and second ends and an outer circumferential surface extending between the ends, a wire insertion hole extending between the first and second ends and defining an inner circumferential surface, a trunk extending from the first end toward the second end, and a fixing portion extending from the trunk to the second end, portions of the wire insertion hole extending through the trunk defining a first substantially uniform internal diameter, portions of the wire insertion hole extending through the fixing portion being gradually reduced from the first diameter adjacent the trunk to a second diameter at locations in proximity to the second end when the trunk is in an unbiased condition, an outer diameter defined by the fixing portion being reduced gradually at farther distances from the trunk when the trunk is in an unbiased condition;

a wire passed through the wire insertion hole and engaged sealingly by the inner circumferential surface;

a terminal fitting having a wire barrel crimped into engagement with the a portion of the wire projecting beyond the second end of the waterproof plug and an insulation barrel crimped into engagement with the fixing portion; and a housing with a terminal insertion hole, the terminal fitting, the wire and the plug being inserted into the terminal insertion hole such that the trunk sealingly engages the housing at the terminal insertion hole.

15. The waterproof resilient plug of claim 14, wherein the trunk has an outer circumferential surface formed with a plurality of annular lips.

16. The waterproof resilient plug of claim 15, wherein annular recesses are formed in the wire insertion hole at locations aligned with the lips.

* * * * *